United States Patent [19]

Tassie

[11] 4,359,927

[45] Nov. 23, 1982

[54] HIGH RATE OF FIRE REVOLVING BATTERY GUN

[75] Inventor: Douglas P. Tassie, St. George, Vt.

[73] Assignee: General Electric Company, Burlington, Vt.

[21] Appl. No.: 230,250

[22] Filed: Feb. 2, 1981

[51] Int. Cl.[3] ..... F41D 7/04

[52] U.S. Cl. ..... 89/12; 89/33 SF

[58] Field of Search ..... 89/12, 7, 33 SF

[56] References Cited

U.S. PATENT DOCUMENTS

| | | | |
|---|---|---|---|
| 125,563 | 4/1872 | Gatling | 89/12 |
| 3,380,341 | 4/1968 | Chiabrandy | 89/12 |
| 3,611,871 | 10/1971 | Kirkpatrick et al. | 89/127 |
| 3,738,221 | 6/1973 | Tan et al. | 89/12 |
| 4,046,056 | 9/1977 | Carrie | 89/12 |
| 4,119,012 | 10/1978 | Frye | 89/33 SF |
| 4,274,325 | 6/1981 | Snyder et al. | 89/12 |

*Primary Examiner*—David H. Brown

*Attorney, Agent, or Firm*—Bailin L. Kuch

[57] ABSTRACT

A feature of this invention is the provision of a Gatling type gun having a firing/safing cam assembly having three dispositions: one permitting firing in one direction of rotation; another permitting firing in the other direction of rotation; and yet another precluding firing in either direction of rotation of the rotor.

7 Claims, 5 Drawing Figures

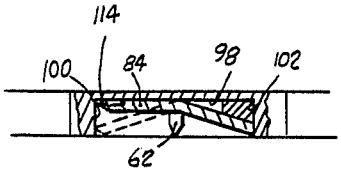
FIG. 3
FIG. 4
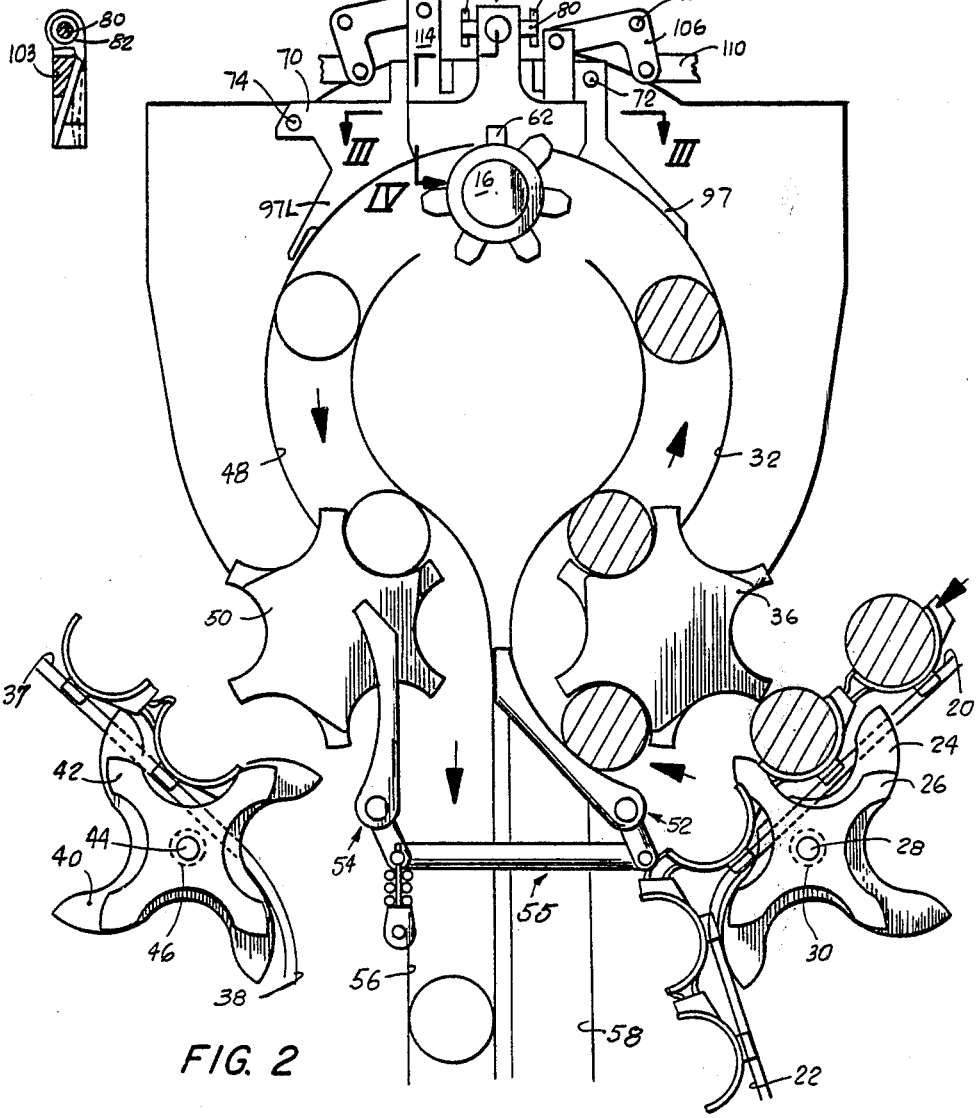
FIG. 2

HIGH RATE OF FIRE REVOLVING BATTERY GUN

BACKGROUND OF THE INVENTION

1. Field of the Invention

This invention relates to Gatling type guns, and more particularly to such a gun which can fire in both directions of rotation of its gun barrel rotor.

2. Prior Art

In U.S. Pat. No. 125,563, issued Apr. 9, 1872 to R. J. Gatling, there is shown the classic modern revolving battery gun. A stationary housing encloses and supports a rotor assembly which has a plurality of gun barrels and a like plurality of gun bolts. Each bolt has its own firing pin and mainspring. As the rotor turns in an invariable direction, each bolt is traversed longitudinally by a stationary elliptical cam track in the housing. As the bolt is traversed forwardly, its firing pin is captured to the rear by a stationary cam track in the housing, compressing its mainspring until the bolt and the barrel reach the firing position, at which position the stationary cam track releases or sears the firing pin.

More modern Gatling type guns are shown by R. E. Chiabrandy in U.S. Pat. No. 3,380,341, issued Apr. 30, 1968; R. G. Kirkpatrick et al in U.S. Pat. No. 3,611,871, issued Oct. 12, 1971; and R. M. Tan et al in U.S. Pat. No. 3,738,221, issued June 12, 1973. In each of these guns the rotor turns in an invariable direction.

In the GAU-8 gun as carried by the A10 aircraft, the rotor turns in one direction to fire rounds, and turns in the opposite direction to clear unfired rounds back into the supply conveyor. A firing/safing cam which is adapted for use in the GAU-8 gun is shown by R. R. Synder et al in U.S. Ser. No. 058,359, filed July 17, 1979 now U.S. Pat. No. 2,274,325.

Each of these guns is adapted to receive only a single train of rounds of ammunition to be fired.

SUMMARY OF THE INVENTION

It is an object of this invention to provide a Gatling type gun which is able to fire in both directions of rotation of its rotor.

It is another object of this invention to provide a Gatling type gun which is able to separate two trains of rounds of ammunition to be fired. Each train may comprise a different kind of ammunition, such as High Explosive and Armor Piercing Indendiary.

A feature of this invention is the provision of a Gatling type gun having a firing/safing cam assembly having three dispositions: one permitting firing in one direction of rotation; another permitting firing in the other direction of rotation; and yet another precluding firing in either direction of rotation of the rotor.

DESCRIPTION OF THE DRAWING

These and other objects, features, and advantages of the invention will be apparent from the following specification thereof taken in conjunction with the accompanying drawing in which:

FIG. 2 is a transverse cross-section view of the gun of FIG. 1;

FIG. 3 is a longitudinal cross-section of the gun of FIG. 2 taken along the plane III—III;

FIG. 4 is a longitudinal cross-section of the gun of FIG. 3 taken along the plane IV—IV.

DESCRIPTION OF THE PREFERRED EMBODIMENT

Figure 1:
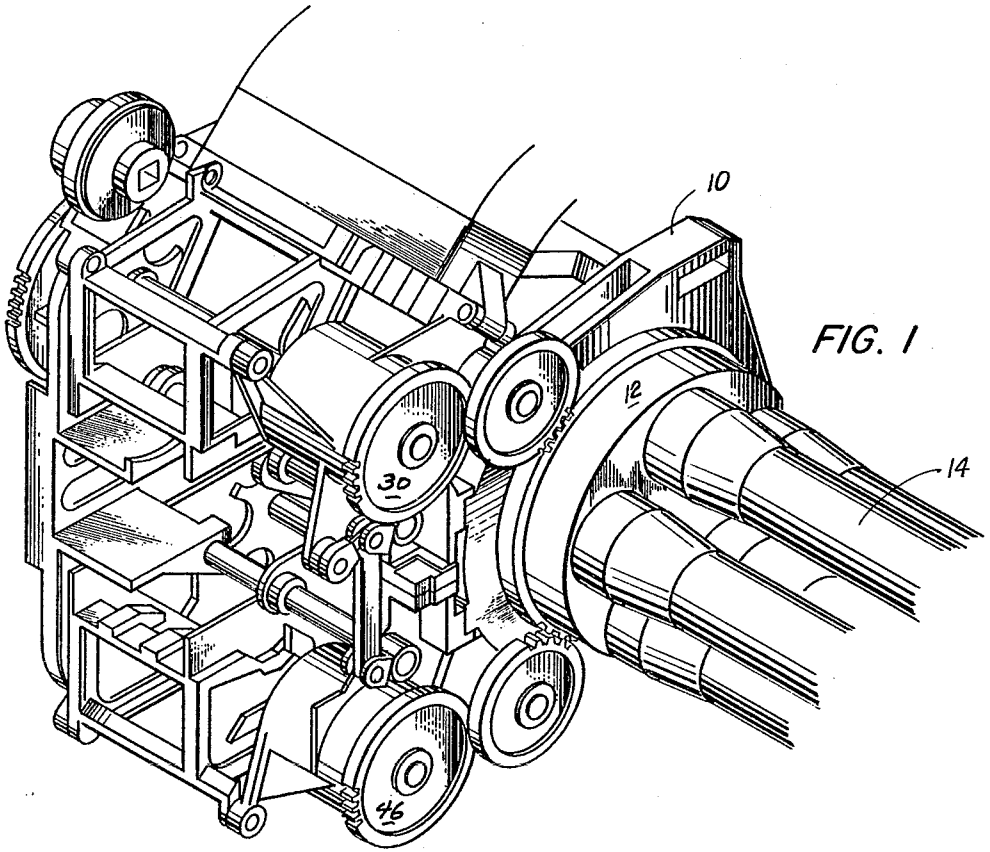
FIG. 1 is a perspective view of a gun embodying this invention.
Figure 5:
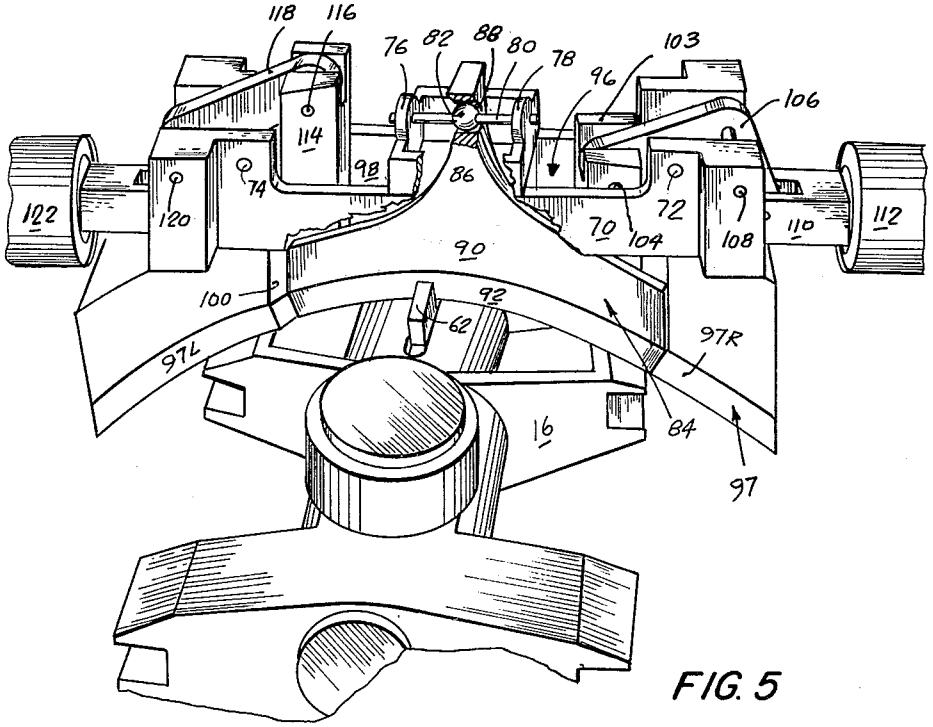
FIG. 5 is a detail in perspective of the firing/safing cam of the gun of FIG. 2.

The gun shown in FIG. 1 is of the general type shown by R. G. Kirkpatrick et al in U.S. Ser. No. 137,704, filed Apr. 7, 1980 now U.S. Pat. No. 4,342,253. It includes a dual feeder as shown by D. P. Tassie in U.S. Ser. No. 230,564 filed Feb. 2, 1981. The gun may be driven in both directions by suitable means, such as the hydraulic system utilized with the GAU-8/A gun in the A10 aircraft, or the system shown by G. W. Carrie in U.S. Pat. No. 4,046,056 issued Sept. 6, 1977.

Alternatively, the electrical system shown by J. A. Kleptz in U.S. Ser. No. 213,243, filed Dec. 14, 1980, may be utilized. Conventionally, such a drive is applied to a ring gear fixed to the gun rotor. In these systems the gun is driven in one direction to fire and in the other direction to clear. The changes in the control system to drive and fire in either direction are thought to be readily apparent.

These disclosures may be referred to for structure not shown or discussed herein.

The gun includes a housing 10 in which is journaled a rotor 12 having a plurality of gun barrels 14 and a like plurality of gun bolts 16, here shown as five in number.

A right hand feed system includes a right hand passageway 20 for a right train of interconnected links and rounds of ammunition which continues as a right hand passageway 22 for stripped links. A right hand round accelerating sprocket 24 and a right hand link pushing sprocket 26 are fixed on a common shaft 28 which is driven through a right cam controlled clutch 30. A second right hand passageway 32 for rounds of ammunition is initially coextensive with the passageway 20 and then diverges towards the rotor 12. A right hand load sprocket 36 is disposed adjacent the second right hand passageway 32. The sprockets 24 and 26 are synchronized in their action and as the link pushing sprocket 26 positively translates a link forwardly along the passageway 20 and then the passageway 22, the round accelerating sprocket 24 positively translates the respective cartridge case forwardly into the passageway 32 and progressively withdraws the case from the link, and accelerates the pitch of the case with respect to that of the gun bolts. The load sprocket engages the accelerated case and places it on the face of a respective gun bolt 16.

A left hand feed system includes a left hand passageway 37 for a left train of interconnected links and rounds of ammunition which continues as a left hand passageway 38 for stripped links. A left hand round accelerating sprocket 40 and a left hand link pushing sprocket 42 are fixed on a left common shaft 44 which is driven through a left cam controlled clutch 46. A second left hand passageway 48 for rounds of ammunition is initially coextensive with the passageway 37 and then diverges towards the rotor 12. A left hand load sprocket 50 is disposed adjacent the second left hand passageway 48. The sprocket 40 and 42 are synchronized in their action and as the link pushing sprocket 42 positively translates a link forwardly along the passageway 37 and then the passageway 38, the round accelerating sprocket 40 positively translates the respective cartridge case forwardly into the passageway 48 and progressively withdraws the case from the link, and accelerates the pitch of the case to that of the gun bolts. The load sprocket 50 engages the accelerated case and places it on the face of a respective gun bolt 16.

A gate mechanism includes a right hand gate 52 and a left hand gate 54 interconnected by a toggle linkage 55 so that in one position the right hand gate blocks the right hand passageway 32 for rounds while the left hand gate clears the left hand passageway 48, and in the other position the right hand gate clears the right hand passageway for rounds while the left hand gate blocks the left hand passageway.

When the right cam clutch 30 is engaged, the sprocket 24 advances rounds along the passageway 32, and if the right hand gate is not already clear, the leading round snaps the right hand gate into its clearing disposition (and the left hand gate into its blocking disposition). The right load sprocket takes each round in sequence and places it on the face of each gun bolt in sequence. Each round is fired while its gun bolt and gun barrel are in the twelve o'clock position. The left hand load sprocket 50 serves as an unload sprocket and takes each fired case in sequence from its respective gun bolt and places it in a left exit passageway 56, which is cleared by the left hand gate 54.

When the left cam clutch 46 is engaged, the sprockets 40 and 42 strip rounds, the left hand gate 54 clears the passageway 48, the left load sprocket 50 hands rounds to the gun bolts, and the right load sprocket 36 serves as an unload sprocket and places the fired cases in a right exit passageway 58, which is cleared by the right hand gate 52.

Each gun bolt is disposed on tracks fixed to the rotor. Each bolt 16 has a roller which rides in a helical cam track in the housing 10, so that as the rotor rotates about the gun longitudinal axis, each gun bolt is traversed fore and aft on its tracks. Each gun bolt has a firing pin 60 with a respective mainspring. Each firing pin has a respective cocking pin 62 standing up through a slot in the body of the gun bolt.

The safing and firing mechanism is fixed in the housing in a transversely extending slot therein.

The safing and firing mechanism includes a main frame 70 which is disposed in the slot of the housing and fixed by a right pin 72 and a left pin 74 passing through aligned bores in the frame and the housing. A pair of ears 76 and 78 extend from the housing and fixed therebetween is a rod 80 on which is fixed a sphere 82. A safing bar 84 of inverted T-shape, has a leg portion 86 with a transverse bore 88 in which the sphere 82 is received. The distal end of the leg portion is constrained between the ears 76 and 78 and yet is provided with a conical freedom of movement by means of the spherical coupling. The cross bar portion 90 has a concave surface 92 adjacent the path of travel of the cocking pins 62 and a convex, U-shaped surface which is remote from the path of travel. The cross bar portion 90 is disposed in a cutout 96 in the main frame in from a cam surface 97 having a backwall 98, a left sidewall 100 and a right sidewall 102.

A right wedge block 103 is disposed in the right corner of the cutout between the backwall and the right sidewall. The upper end of the block 103 is coupled by a pivot 104 to one arm of a right rocker link 106. The rocker link is journaled on a pivot 108 which is fixed to the housing, and its other arm is coupled to a link 110 which is coupled to a spring returned solenoid 112. The spring normally biases the wedge block down, and the solenoid, when energized, pulls the wedge block up.

A left wedge clock 114 is disposed in the left corner of the cutout between the backwall 98 and the left sidewall 100. The upper end of the block is coupled by a pivot 116 to one arm of a left rocker link 118. The rocker link is journaled on a pivot 120 which is fixed to the housing, and its other arm is coupled to a link which is coupled to a spring returned solenoid 122. The spring normally biases the wedge block down, and the solenoid, when energized, pulls the wedge block up.

When the left solenoid is energized, and the right solenoid is not energized, the left wedge block is raised, permitting the left portion of the safing bar 84 to contact the backwall 98 and to expose the left sidewall 100, and the right wedge block is lowered, forcing the right portion of the safing bar away from the backwall so that the right edge of the concave surface 92 is level with the cam surface 97 and the right sidewall is concealed. When the rotor rotates in the clockwise direction, as seen in FIG. 2, the gun bolt is driven progressively forwardly as it approaches the twelve o'clock position and the cocking pin initially engages the left portion 97L of the cam surface 97 and progressively compresses the mainspring of the gun bolt until the cocking pin falls off the cam surface at the left sidewall 100, releasing the firing pin to fire the round of ammunition. The cocking pin falls to the left portion of the concave surface 92 and rides across the concave surface until it rides back onto the right portion 97R of the cam surface.

When the right solenoid is energized, and the left solenoid is not energized, the right wedge block is raised permitting the right portion of the safing bar 84 to contact the backwall 98 and to expose the right sidewall 102, and the left wedge block is lowered, forcing the left portion of the safing bar away from the backwall so that the left edge of the concave surface is level with the cam surface 97 and the left sidewall is concealed. When the rotor rotates in the counterclockwise direction, as seen in FIG. 2, the gun bolt is driven progressively forward as it approaches the twelve o'clock position and the cocking pin initially engages the right portion 97R of the cam surface 97 and progressively compresses the mainspring of the gun bolt until the cocking pin falls off the cam surface at the right sidewall 102, releasing the firing pin to fire the round of ammunition. The cocking pin falls to the right portion of the concave surface 92 and rides across the concave surface until it rides back onto the left portion 97L of the cam surface.

When neither solenoid is energized, both wedge blocks are lowered, forcing both portions of the safing bar away from the backwall so that both edges of the concave surface are level with the cam surface 97 and both sidewalls are concealed. When the rotor rotates in either direction, it approaches the twelve o'clock position, the cocking pin will engage the cam surface 97 and compress the mainspring. However, the concave surface carries the cocking pin from one side to the other without permitting it to fall and thereby release the firing pin. This is a fully safe disposition.

Should the rotor be halted with a cocking pin abutting the concave surface 92, if both solenoids are not energized, the return springs of the solenoids will overcome the bias of the firing pin mainspring, forcing the firing pin back into the gun bolt face. This will result in a fully safe disposition. This may be confirmed by thrusting left and right pins through left and right longitudinal bores 126 and 128 in the wedge blocks and the adjacent portions of the housing.

It will be obvious that other advantages are obtained from a gun which can fire in either direction. One is that dual feed can be provided by having a feeder on each side of the gun. Another is that single feeds can be accommodated for right and left installations where feed run is a constraint.

I claim:

1. A Galting type gun comprising:

a housing having a longitudinal axis;

a rotor journaled for clockwise and counterclockwise rotation about said longitudinal axis;

a gun bolt carried by said rotor and having a firing pin and a cocking pin coupled thereto;

firing and safing cam means coupled to said housing and having a first disposition for causing said cocking pin to cock and to fire said firing pin during clockwise rotation of said rotor, a second disposition for causing said cocking pin to cock and to fire said firing pin during counterclockwise rotation of said rotor, and a third disposition for precluding said cocking pin from firing said firing pin during rotation of said rotor.

2. A Gatling type gun according to claim 1 further including:

means for feeding a first train of rounds to said gun bolt when said rotor rotates clockwise and for feeding a second train of rounds to said gun bolt when said rotor rotates counterclockwise.

3. A gun according to claim 1 wherein:

said firing and safing cam means has a cam surface for engaging said cocking pin, and when in its first disposition provides a first lacuna in said surface to cause firing of said firing pin, when in its second disposition provides second lacuna in said surface to cause firing of said firing pin, and when in its third disposition has a continuum in said surface to preclude firing of said firing pin.

4. A gun according to claim 3 wherein:

said gun bolt includes a spring which is compressed by said cocking pin to cock said firing pin and released by said cocking pin to fire said firing pin.

5. A gun according to claim 1 wherein:

said firing and safing cam means includes a first cam surface for initially engaging said cocking pin as said rotor turns clockwise, a second cam surface for initially engaging said cocking pin as said rotor turns counterclockwise, first means for providing any one of an initial drop from said first cam surface and a subsequent progressive rise from said drop to said second cam surface in the clockwise direction, an initial drop from said second cam surface and a subsequent progressive rise from said drop to said first cam surface in the counterclockwise direction, and a continuum between said first and second cam surfaces.

6. A gun according to claim 5 wherein:

said first means includes a pivotal element having a concave surface extending between a first side edge and a second side edge, control means for causing said pivotal element to assume any one of the following dispositions:

a first disposition whereat said first side edge is spaced from said first cam surface and said second side edge is closely adjacent to said second cam surface, a second disposition whereat said second side edge is spaced from said second cam surface and said first side edge is closely adjacent to said first cam surface, and a third disposition whereat said first side edge is closely adjacent to said first cam surface and said second side edge is closely adjacent to said second cam surface.

7. A gun according to claim 6 wherein:

said control means includes first forcing means having two dispositions, the first disposition forcing said first side edge to a disposition closely adjacent said first cam surface, and the second disposition freeing said first side edge to move away from said first cam surface;

second forcing means having two dispositions, the first disposition forcing said second side edge to a disposition closely adjacent said second cam surface, and the second disposition freeing said second side edge to move away from said second cam surface.

* * * * *

UNITED STATES PATENT AND TRADEMARK OFFICE

CERTIFICATE OF CORRECTION

PATENT NO. : 4,359,927

DATED : November 23, 1982

INVENTOR(S) : Douglas P. Tassle

It is certified that error appears in the above-identified patent and that said Letters Patent are hereby corrected as shown below:

Column 1, line 36, change "Synder" to --Snyder--.

Column 1, line 37, change "2,274,325" to --4,274,325--.

Column 4, line 3, change "clock" to --block--.

Signed and Sealed this

*Thirty-first* Day of *May 1983*

[SEAL]

*Attest:*

DONALD J. QUIGG

*Attesting Officer*

*Acting Commissioner of Patents and Trademarks*